US011136685B2

(12) United States Patent
Müll et al.

(10) Patent No.: US 11,136,685 B2
(45) Date of Patent: Oct. 5, 2021

(54) METHOD AND DEVICE FOR THE GALVANIC APPLICATION OF A SURFACE COATING

(71) Applicant: TOPOCROM SYSTEMS AG, Neuhausen am Rheinfall (CH)

(72) Inventors: Karl Müll, Volketswil-Kindhausen (CH); Thomas Bolch, Abstatt (DE)

(73) Assignee: TOPOCROM SYSTEMS AG, Neuhausen Am (CH)

( * ) Notice: Subject to any disclaimer, the term of this patent is extended or adjusted under 35 U.S.C. 154(b) by 238 days.

(21) Appl. No.: 15/773,734

(22) PCT Filed: Nov. 5, 2015

(86) PCT No.: PCT/EP2015/075850
§ 371 (c)(1),
(2) Date: May 4, 2018

(87) PCT Pub. No.: WO2017/076456
PCT Pub. Date: May 11, 2017

(65) Prior Publication Data

US 2018/0320281 A1 Nov. 8, 2018

(51) Int. Cl.
*C23C 28/00* (2006.01)
*C25D 3/06* (2006.01)
(Continued)

(52) U.S. Cl.
CPC ..... *C25D 3/06* (2013.01); *C25D 5/04* (2013.01); *C25D 5/14* (2013.01); *C25D 5/36* (2013.01);
(Continued)

(58) Field of Classification Search
CPC ..... C23C 28/00
(Continued)

(56) References Cited

U.S. PATENT DOCUMENTS 3,406,105 A 10/1968 Letendre
4,190,516 A * 2/1980 Kajimaya ..... C25B 1/46 204/290.01
(Continued)

FOREIGN PATENT DOCUMENTS

CA 2 172 613 C 6/2003
EP 0 565 070 A1 10/1993
(Continued)

OTHER PUBLICATIONS

International Search Report Corresponding to PCT/EP2015/075850 dated Sep. 9, 2016.
(Continued)

*Primary Examiner* — Edna Wong
(74) *Attorney, Agent, or Firm* — Finch & Maloney, PLLC; Michael J. Bujold; Jay S. Franklin

(57) ABSTRACT

A method for galvanic application of a surface coating, in particular a chromium coating, to a body, for example a machine component. Before the galvanic application of the surface coating, a layer of a compound that can be oxidized by an electrolyte solution that is used, preferably a polyhydroxy compound with a viscosity of at least 1000 mPas at 25° C., is applied to the body. A method for galvanic application of a surface coating, in particular a chromium coating, to a body, for example a machine component, wherein the surface coating is carried out in a closed reactor in an at least two-stage, preferably three-stage process, is also disclosed. An electrolyte solution contained in the reactor at a temperature T1 for carrying out a subsequent process stage is substituted by an electrolyte solution at a temperature T2≠T1. A device for carrying out this method is also disclosed.

3 Claims, 1 Drawing Sheet

(51) Int. Cl.

| | |
|---|---|
| ***C25D 5/04*** | (2006.01) |
| ***C25D 5/14*** | (2006.01) |
| ***C25D 5/36*** | (2006.01) |
| ***C25D 7/00*** | (2006.01) |
| ***C25D 17/02*** | (2006.01) |
| ***C25D 21/02*** | (2006.01) |
| ***C25D 21/04*** | (2006.01) |
| ***C25D 21/14*** | (2006.01) |
| *C25D 21/12* | (2006.01) |

(52) U.S. Cl.
CPC ..... *C25D 7/00* (2013.01); *C25D 17/02* (2013.01); *C25D 21/02* (2013.01); *C25D 21/04* (2013.01); *C25D 21/14* (2013.01); *C25D 21/12* (2013.01)

(58) Field of Classification Search
USPC ..... 205/183
See application file for complete search history.

(56) References Cited

U.S. PATENT DOCUMENTS

| | | | | |
|---|---|---|---|---|
| 4,820,813 | A * | 4/1989 | Schulz | C08B 11/20 536/84 |
| 5,415,761 | A | 5/1995 | Müll | |
| 2004/0206622 | A1 | 10/2004 | Kawakami et al. | |
| 2006/0201801 | A1* | 9/2006 | Bartlett | H01M 10/345 204/284 |
| 2011/0027940 | A1 | 2/2011 | Oladeji | |
| 2014/0083843 | A1 | 3/2014 | Chuang et al. | |
| 2016/0021930 | A1* | 1/2016 | Minskoff | H05B 3/0014 131/329 |

FOREIGN PATENT DOCUMENTS

| | | | | |
|---|---|---|---|---|
| EP | 0 722 515 B1 | | 1/1998 | |
| EP | 3 000 918 A1 | | 3/2016 | |
| GB | 335 161 | | 9/1930 | |
| GB | 1 312 723 | | 4/1973 | |
| JP | 56069393 A | * | 6/1981 | C25D 13/20 |
| JP | H08-218193 A | | 8/1996 | |
| WO | 95/09938 A1 | | 4/1995 | |

OTHER PUBLICATIONS

Invitation to Pay Fees Corresponding to PCT/EP2015/075850 dated Jul. 18, 2016.
Written Opinion Corresponding to PCT/EP2015/075850 dated Sep. 9, 2016.
European Search Report Corresponding to 14186089.0 dated Apr. 2, 2015.
European Search Report Corresponding to 14186089.0 dated Jul. 3, 2017.

* cited by examiner

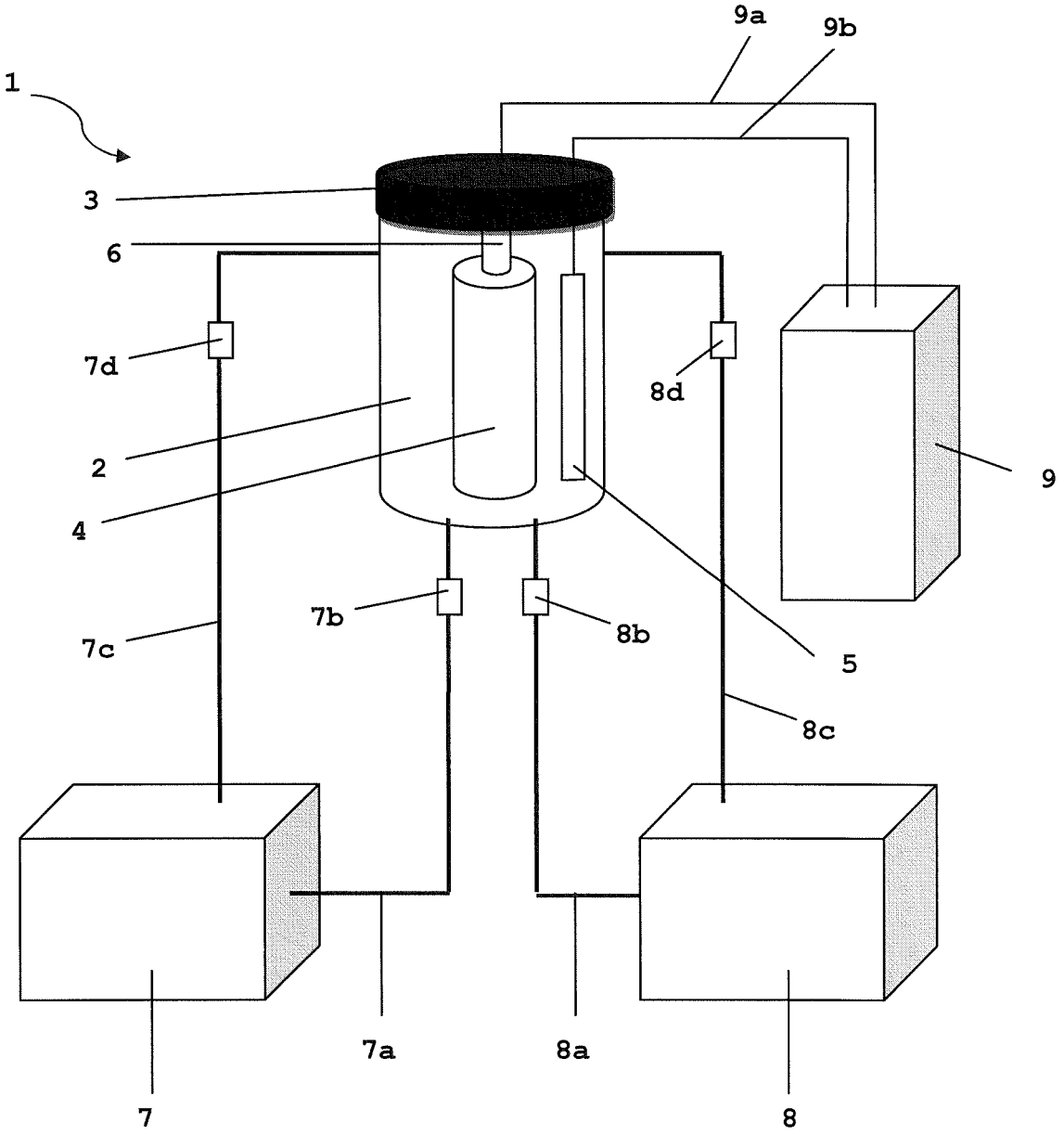
9a
9b
1
3
6
7d
8d
2
4
9
7b
8b
7c
5
8c
7a
8a
7
8

METHOD AND DEVICE FOR THE GALVANIC APPLICATION OF A SURFACE COATING

The present invention relates to a process and an apparatus for the electrochemical application of a surface coating, in particular a chromium coating.

For various industrial applications, it is desirable or even necessary to use machine components having particular surface properties. Examples which may be mentioned are filament-guiding components in the textile and carbon fiber sector, rolls and rollers in the printing sector, rollers in intake machines in the sheet metal industry and also dressing rollers for texturing metal sheets for, for example, the automobile industry.

One suitable method for providing such surface coatings is chromium plating of a corresponding component.

EP-0 565 070 B1 and EP-0 722 515 B1 describe a process for electrochemical surface coating by means of which a chromium coating is applied electrochemically to the surface of a substrate under particular current conditions. This process has now become established on the market as the TOPOCROM® process. The TOPOCROM® process enables a chromium coating to be applied in various variations in a simple manner without mechanical or chemical after-treatments of the coated surface being necessary.

In an illustrative embodiment, the TOPOCROM® process is carried out in an electrolysis bath which contains a chromium electrolyte, for example a chromium electrolyte containing sulfuric acid. The component to be coated forms the cathode. In addition, an anode (for example made of platinated titanium) is dipped into the electrolysis bath. Application of direct current results in deposition of a chromium layer on the component functioning as cathode.

The TOPOCROM® process described in EP-0 565 070 B1 and EP-0 722 515 B1 functions very successfully and reliably. However, it has been found that the process conditions could be optimized still further or should be adapted because of changed requirements by authorities. Thus, in the European Union area, the use of compositions containing chromic acid are being regarded increasingly critically because of the high toxicity of Cr(VI) compounds. A completely closed, emission- and waste water-free process with very efficient recycling of the electrolyte would therefore be desirable or could possibly be required in the future.

It was an object of the present invention to provide an improved process for the electrochemical application of a surface coating, in particular a chromium coating, to a machine component.

The above object is achieved by the subject matter of the independent claims.

Specifically, the present invention provides a process for the electrochemical application of a surface coating, in particular a chromium coating, to a body, for example a machine component, wherein a layer of a compound, preferably a polyhydroxy compound, which can be oxidized by an applied electrolyte solution, and which has a viscosity of at least 1000 mPas at 25° C., is applied to the body before the electrochemical application of the surface coating.

Processes for the electrochemical application of a surface coating are adequately known. In principle, these are electrochemical processes in which electrodes are introduced into an electrolyte bath. If direct current is applied to the electrodes, a redox reaction (electrolysis) and associated generation of chemical elements or compounds at the electrodes occur.

In the case of chromium plating of a surface, a solution containing chromic acid is used as electrolyte. Chromic acid ($H_2CrO_4$) is formed in dilute aqueous solutions of $CrO_3$. The reduction of the Cr(VI) ions in the electrolyte to the element Cr occurs in the presence of a catalyst. Use is usually made of sulfuric acid ($H_2SO_4$) either alone or together with hydrofluoric acid, complex fluorides or an aliphatic sulfonic acid having from 1 to 3 carbon atoms (preferably methanesulfonic acid). Customary electrolyte solutions contain, for example, 250 g of $CrO_3$ and 2.5 g of sulfuric acid in 1 l of water, or 200-300 g of $CrO_3$, 1.9-3.3 g of $H_2SO_4$ and 1.5-12 g of methanesulfonic acid in 1 l of water.

As anode, an electrode composed of lead or preferably of platinated titanium can be used in chromium plating.

As cathode, the body to be coated with chromium is used in chromium plating. In principle, any body which can be coated with chromium can be used as cathode. According to the invention, the body to be coated is preferably a machine component, for example conveying rollers for the textile and carbon fiber sector, rolls and rollers in the printing sector, rollers in intake machines in the sheet metal industry and also dressing rollers for texturing metal sheets for, for example, the automobile industry.

Such bodies are usually made of iron or steel, but can also consist of other materials.

According to the invention, the body to be coated is preferably a rotationally symmetric body which can be rotated during the electrochemical process in order to achieve a uniform surface coating.

The chromium plating is usually carried out using a direct current of from 10 to 200 A/dm$^2$, preferably from 25 to 150 A/dm$^2$ and particularly preferably from 30 to 100 A/dm$^2$. Particular preference is given here to employing electric current conditions as are described in EP-0 565 070 B1 and EP-0 722 515 B1, i.e. by means of a direct current application process in which formation of nuclei of the material to be deposited is achieved on the surface to be coated by means of at least one initial impulse of the electric voltage and/or the electric current and growth of the nuclei of material to be deposited is subsequently brought about by means of at least one subsequent impulse by attachment of further material to be deposited, wherein the increase in the electric voltage and/or the electric current is carried out in a plurality of stages during the nucleation phase and the time between increases is in the range from 0.1 to 30 seconds, with current density changes being carried out in steps of from 1 to 6 mA/cm$^2$.

The body functioning as cathode usually goes through a plurality of pretreatment steps before use in the electrochemical deposition process described. In particular, the chromium plating of surfaces is difficult and proceeds with low current yields in the range of only about 15-20%. For the deposition of chromium, it is necessary to have a high current density (overpotential) as a result of which the reduction to elemental chromium at the cathode competes with the formation of hydrogen (from the $H_3O^+$ ions of the acidic aqueous electrolyte solution) and the formation of $Cr^{3+}$ ions from the chromic acid. The current density required for deposition of chromium is dependent, inter alia, on the cathode material and the nature of the surface of the cathode material. To reduce the current density necessary for deposition of chromium, cathode materials are usually mechanically pretreated, for example by grinding or sandblasting, in order to obtain a very smooth surface. Additional chemical and/or electrochemical pretreatment steps usually follow. The total pretreatment of the body to be coated requires a plurality of separate pretreatment baths, wastewater is produced and comprehensive measures for protection in the workplace have to be undertaken.

The present invention provides a simple but very advantageous method for pretreating the body to be coated. According to the invention, the surface of the body to be coated is provided with a layer of a compound, preferably a polyhydroxy compound, having a viscosity of at least 1000 mPas at 25° C., and which can be oxidized by an applied electrolyte solution.

According to the invention, the pretreatment can be carried out using any compound which on the one hand can be oxidized by an electrolyte solution which is used but, on the other hand, is sufficiently viscous for it to have a sufficiently long residence time on the surface of the body to be coated and not to flow off too quickly from the surface, i.e. for it to form a surface film.

Cr(VI) compounds are known to be strong oxidants and can, for example, oxidize alcohols. It has been found according to the invention that polyhydroxy compounds, i.e. chemical compounds having at least two hydroxy groups, are very suitable for the pretreatment according to the invention, as long as they have a sufficient viscosity. According to the invention, the polyhydroxy compound is preferably selected from the group consisting of glycerol, carbohydrates, such as glucose, fructose or sucrose, preferably glucose, and particular polyalkylene oxides such as polyethylene glycol. According to the invention, polyalkylene oxides which are liquid at room temperature or solutions of polyalkylene oxides such as polyethylene glycol 1500 (from Merck) can be used. Preference is given according to the invention to glycerol or polyethylene glycol 1500.

The compound to be used for the pretreatment has to be sufficiently viscous for it to have a sufficiently long residence time on the surface of the body to be coated and not to flow off from the surface too quickly. According to the invention, the compound to be used should have a viscosity of at least 1000 mPas at 25° C. Here, according to the invention, the viscosity is a dynamic viscosity determined using a conventional rotational viscometer (Searle system) in accordance with DIN 53 019-1; 2008-09 at 25° C.

According to the invention, the upper limit to the viscosity of the compound to be used for the pretreatment is not critical. According to the invention, a compound to be used for the pretreatment preferably has a viscosity of from 1000 mPas to 6000 mPas, more preferably from 1200 to 4500 mPas, at 25° C.

The compound to be used for the pretreatment can be applied manually using a cleaning cloth impregnated with the substance or preferably mechanically to the surface of the body to be coated. Preference is given to application by means of a vibrational grinder which is provided with the compound to be used for the pretreatment and is moved uniformly over the surface of the body to be coated.

The pretreatment step according to the invention leads to various unexpected advantages.

This pretreatment makes the otherwise customary, above-described complicated pretreatment obsolete. The body to be coated can, after a possible mechanical pretreatment such as grinding or sandblasting, be subjected to the electrochemical coating process without additional complicated chemical and/or electrochemical pretreatment steps. According to the invention, the body to be coated is preferably merely cleaned by means of an alcohol, preferably ethanol, before the pretreatment process of the invention. For example, cleaning cloths impregnated with alcohol can be provided and moved either manually or by means of an appropriate machine over the surface of the body to be coated. In this way, residues present on the surface are removed by a possible mechanical pretreatment such as grinding or sandblasting.

Owing to the omission of the customary complicated chemical and/or electrochemical pretreatment steps, a considerable part of the wastewater to be disposed of does not arise and it is not necessary to undertake any comprehensive measures for protection at the workplace since the pretreatment according to the invention can be carried out using nonhazardous chemical substances which can be handled safely.

It has been found, according to the invention, that very effective activation of the surface of the body to be coated is achieved by means of the pretreatment according to the invention. Without wishing to be tied to a theory, a chemical reaction between the electrolyte, preferably a chromic acid electrolyte, and the oxidizable layer on the body to be coated presumably occurs already in the zero-current state, i.e. before commencement of the actual electrochemical deposition. In the case of a chromic acid electrolyte, this reaction probably leads to formation of a layer containing $Cr^{3+}$ ions on the surface of the body to be coated.

This layer obviously assists the subsequent deposition of chromium during the electrochemical process, which can be concluded from the fact that the pretreatment according to the invention makes an otherwise customary change in polarity of the electrodes in order to activate the surface of the body to be coated unnecessary. This represents a considerable advantage since iron ions (in the case of a body to be coated made of iron) or other foreign ions are formed and go into the electrolyte during a customary change of polarity of the electrodes. This leads to increasing contamination of the electrolyte and makes relatively early replacement thereof necessary. In contrast, this polarity change step is dispensed with when using the process of the invention, as a result of which the life of the electrolyte is greatly increased. This is of considerable importance, especially with a view to the tighter regulations which are to be expected for handling of Cr(VI)-containing compositions.

In addition, the omission of the polarity change step makes it possible to use cheaper rectifiers (rectifiers whose polarity cannot be changed).

Finally, it has been found that chromium coatings which adhere better can be produced as a result of the pretreatment according to the invention. This is attributable to the fact that a uniform layer containing $Cr^{3+}$ ions is formed on the surface of the body to be coated as a result of the initial chemical reaction in the zero-current state and this subsequently leads, on application of an electric current, to formation of a uniform chromium layer. In comparison, a chromium coating deposited exclusively under electrochemical conditions has been found to adhere less well and be disadvantageous.

In the case of conventional electrochemical coating processes, for example a chromium plating process such as the TOPOCROM® process, a plurality of metal layers, preferably chromium layers, are deposited on top of one another. For example, a primer layer which has few cracks and has a thickness of preferably from 25 to 40 μm, in particular 30 μm, is firstly applied in one embodiment of the TOPOCROM® process. A structured layer can subsequently be applied to this primer layer. For example, in the TOPOCROM® process, the structured chromium layer formed there comprises hemispherical domes. A covering layer which preferably has a thickness of preferably from 2 to 20 μm, particularly preferably from 3 to 15 μm and in particular from 4 to 10 μm, can subsequently be applied to the structured layer in order to protect the structured layer. The production of such a three-layer structure composed of chromium is described, for example, in EP-0 565 070 B1 and EP-0 722 515 B1.

In order to deposit the various chromium layers, it is necessary to vary the temperature of the electrolyte as a function of the layer to be deposited. The heating of the electrolyte usually occurs directly in the electrolysis reactor, for example by means of external heating elements. However, this is disadvantageous in a process which is completely closed as desired for environmental protection reasons and because of regulatory requirements. Matching the temperature of the electrolyte to the desired process temperature requires a comparatively high effort and is time-consuming. As a result of external heating, undesirable secondary reactions can occur in the electrolysis reactor and the electrolyte used has a shorter life. These disadvantages are likewise overcome by the present invention.

The present invention further provides a process for the electrochemical application of a surface coating, in particular a chromium coating, to a body, for example a machine component, where surface coating is carried out in a, preferably closed, reactor in an at least two-stage, preferably three-stage, process, characterized in that an electrolyte solution having a temperature T1 present in the reactor is replaced by an electrolyte solution having a temperature T2≠T1 for carrying out a subsequent process step.

The process of the invention makes it possible to carry out the entire electrochemical process in a closed reactor, with the electrochemical process being able to be used for building up a plurality of layers. Here, building up a plurality of layers means the production of at least two, preferably three, but optionally even more layers on top of one another on the surface of a body to be coated.

The process of the invention leads to a defect-free multilayer coating on the surface of a body to be coated without the body having to be taken from the reactor for this purpose. The process can be operated so as to meet the presently expected tightening of regulatory requirements and in a wastewater—and emission-free manner (i.e. without pollution of the workplace by emissions; the waste air from the reactor is discharged via a closed system; purified and can then be discharged without problems). The process is operated under very mild conditions in respect of the electrolytes used. The electrolytes used have a very long life, which is of considerable importance especially with a view to the tightened regulations to be expected for handling Cr(VI)-containing compositions.

According to the present invention, the individual process steps are not realized by a single electrolyte present in the reactor being heated or cooled. Rather, according to the invention, an electrolyte solution having a temperature T1 is replaced by an electrolyte solution having a temperature T2≠T1 for the next process stage, i.e. exchange of the electrolyte solutions takes place.

According to the invention, the exchange is preferably achieved by the replacement of the electrolyte solution having a temperature T1 by an electrolyte solution having a temperature T2≠T1 being carried out by introduction of the electrolyte solution having a temperature T2≠T1 into the reactor and resulting displacement of the electrolyte solution having a temperature T1.

This can, for example, be achieved by at least one inlet for an electrolyte solution having a temperature T2≠T1 being arranged in the bottom plate of the reactor or in the lower region, preferably in the lower third, particularly preferably in the lower quarter, of the reactor for carrying out the electrochemical process. Through this inlet, electrolyte solution having a temperature T2≠T1 can be introduced from a reservoir into the reactor, for example by means of a pump. The inlet is preferably equipped with a shut-off device, for example a valve or a gate. At the same time, at least one outlet opening is arranged in the upper region, preferably in the upper third and particularly preferably in the upper quarter, of the reactor. If the inlet into the reactor is then opened and electrolyte solution having a temperature T2≠T1 is introduced into the reactor, this electrolyte displaces the electrolyte having a temperature T1 which is present in the reactor, with the electrolyte having the temperature T1 being discharged from the reactor through the outlet. The outlet can be equipped with a shut-off device, for example a valve or a gate. As an alternative, the outlet can also be configured as overflow system, i.e. at the normal level of electrolyte in the reactor, the outlet is located above the electrolyte. Only when electrolyte solution having a temperature T2≠T1 is introduced into the reactor is the level of electrolyte in the reactor raised in such a way that it reaches the outlet and can flow out from the reactor through this.

According to the invention, the various electrolyte solutions are preferably stored in separate containers and brought to the desired temperature outside the reactor for carrying out the electrochemical process. The containers can be conventional liquid tanks which are resistant to the electrolytes used. The temperature of the electrolyte can be set in a known manner, for example by means of heating elements.

The electrolyte containers are connected via connecting conduits, preferably pipes, to the reactor for carrying out the electrochemical process. The pipes coming from the various electrolyte containers can open via separate inlets into the reactor. However, it is also possible for the pipes coming from the various electrolyte containers to be joined upstream of the reactor and open into the reactor via a single inlet. In the latter case, shut-off devices, for example a valve or a gate, should be provided in the individual pipes upstream of the point at which the pipes join in order to allow selective introduction of a particular electrolyte solution into the reactor.

In an analogous way, the outlet or outlets from the reactor are connected via connecting conduits, preferably pipes, to the respective electrolyte containers. The pipes leading into the various electrolyte containers can be joined to the interior of the reactor via separate outlets in the upper region of the reactor. However, it is also possible for the pipes leading into the various electrolyte containers to be joined outside the reactor and be connected to the interior of the reactor via a single outlet. In the latter case, shut-off devices, for example a valve or a gate, should be provided in the individual pipes upstream of the point at which the pipes join in order to allow selective transfer of a particular electrolyte solution from the reactor into the container provided for this electrolyte solution.

Furthermore, preference is given, according to the invention, to circulating the electrolyte solution present in the reactor during a process step continuously by discharge from the reactor and replacement with the same electrolyte solution. This can, for example, be carried out by this electrolyte solution being able to flow through an inlet into the reactor and an outlet from the reactor (preferably by opening appropriate shut-off devices) and this electrolyte solution being continuously circulated, for example by operation of a circulation pump. This ensures constant quality of the electrolyte solution in the reactor.

The present invention thus further provides an apparatus for the electrochemical application of a surface coating, in particular a chromium coating, in particular for carrying out a process as described above, comprising a reactor for accommodating a body, for example a machine component, to be coated, an anode and at least two, preferably two, electrolyte containers, characterized in that the electrolyte containers are connected via connecting conduits through separate inlets and outlets to the interior of the reactor.

The process of the invention is particularly preferably configured in such a way that surface coating is carried out in a three-stage process, with the first process step being carried out in the reactor using an electrolyte solution having a temperature T1, the second process step subsequently being carried out using an electrolyte solution having a temperature T2≠T1 and the third process step being carried out using an electrolyte solution having a temperature T3≠T2. Here, the temperature T3 is particularly preferably equal to the temperature T1. According to a preferred embodiment, T2<T1 and very particularly preferably T2<T1 and T1=T3.

This embodiment of the process of the invention can be used in order to apply a chromium primer layer, a structured chromium layer and a covering layer in succession in three successive process steps in a chromium coating operation. These process steps can be carried out using the electric current conditions as described in EP-0 565 070 B1 and EP-0 722 515 B1. In the first process step, the deposition of the primer layer composed of chromium, an electrolyte which has a temperature in the range from 40 to 60° C., preferably from 45 to 55° C., is introduced into the reactor. As soon as the formation of the primer layer has been concluded, this electrolyte is replaced by a second electrolyte which has a lower temperature in the range from 25 to 39° C., preferably from 30 to 38° C. The deposition of the structured chromium layer is carried out by means of this second electrolyte. As soon as the formation of the structured chromium layer has been concluded, this electrolyte is replaced by a third electrolyte which once again has a higher temperature in the range from 40 to 60° C., preferably from 45 to 55° C. The deposition of the covering layer composed of chromium is carried out by means of this third electrolyte. If the same temperature is to be set for the first and third electrolytes, the same electrolyte can also be used for the first process step and the third process step.

The reactor for carrying out the electrochemical process can have any shape. A cylindrical shape is preferred. Height and base area of the reactor can be varied depending on the body to be coated.

According to the invention, the top face of the reactor can preferably be opened, i.e. be configured, for example, in the form of a lid, in order to introduce the body to be coated into the reactor.

As described above, the reactor is equipped with one or more inlets and one or more outlets for the electrolyte solutions, which inlets and outlets are connected via appropriate connecting conduits to the containers for the electrolyte solutions.

Furthermore, the reactor is connected via electric conductors to a rectifier from which the reactor is supplied with the current necessary for the electrochemical process. Rectifiers are known and do not have to be explained in more detail here. As indicated above, it is not necessary according to the invention to use rectifiers whose polarity can be changed, since a change of polarity is not necessary for the process of the invention. According to the invention, it is therefore advantageously possible to use cheaper rectifiers whose polarity cannot be changed.

An anode is arranged in a fixed manner within the reactor. As described above, an anode made of platinated titanium is preferably used in the process of the invention. Although lead electrodes can also be used in many cases, these have some disadvantages.

In the operating state, the body to be coated, which functions as cathode, is arranged in the reactor in such a way that its surface is at a distance in the range from 5 to 80 cm, preferably from 30 to 60 cm, from the anode.

In principle, as described above, any body which can be coated by means of the process of the invention, preferably coated with chromium, can be used as cathode. According to the invention, the body to be coated is preferably a component of a machine, for example conveying rollers for the textile and carbon fiber sector, rolls and rollers in the printing sector, rollers in intake machines in the sheet metal industry and also dressing rollers for texturing metal sheets for, for example, the automobile industry.

Such bodies are usually made of iron or steel, but can also consist of other materials.

According to the invention, the body to be coated is preferably a rotationally symmetric body which can be rotated during the electrochemical process in order to achieve a uniform surface coating.

For this purpose, the reactor is preferably equipped with a motor for turning the body. According to the invention, the motor is preferably arranged at the top of the reactor and can be connected in a simple way, for example by means of a plug connection, to the body to be coated.

According to the invention, the electrochemical process is preferably carried out with rotation of the rotationally symmetric body to be coated.

Particular preference is given according to the invention to combining both the measures described here with one another, i.e. the electrochemical process is carried out in an at least two-stage, preferably three-stage, process in which an electrolyte solution having a temperature T1 present in the reactor is replaced by an electrolyte solution having a temperature T2≠T1 for carrying out a subsequent process step, with a layer of a compound which can be oxidized by an applied electrolyte solution, said compound being preferably a polyhydroxy compound, having a viscosity of at least 1000 mPas at 25° C., being applied to the body before the electrochemical application of the surface coating.

As stated above, the polyhydroxy compound is, according to the invention, preferably selected from the group consisting of glycerol, carbohydrates and particular polyalkylene oxides such as polyethylene glycol, for example polyethylene glycol 1500 (from Merck). According to the invention, polyalkylene oxides which are liquid at room temperature or solutions of polyalkylene oxides can be used. Preference is given, according to the invention, to glycerol or polyethylene glycol 1500.

The pretreatment can be carried out as described above.

Furthermore, preference is given according to the invention to the reactor being operated by means of a ventilation system for removing gases formed during surface coating. While the electrochemical process is being carried out, hydrogen is formed at the cathode and oxygen is formed at the anode. To avoid the formation of a oxyhydrogen gas mixture, the gaseous atmosphere in the reactor is preferably removed, for example by means of a suction pump, either continuously or at particular points in time.

As soon as the body which is to be coated and has preferably been pretreated according to the invention has been introduced into the reactor and the reactor has been closed, the entire process of the invention can be carried out in a completely closed plant. All process parameters and process steps, e.g. regulation of the electric current, introduction and discharge of the various electrolyte solutions, optionally the extraction of the reactor atmosphere, can be monitored and carried out with the aid of an electronic control unit.

After the electrochemical deposition process is complete, the entire electrolyte solution is removed from the reactor and the coated body is preferably cleaned using water or an aqueous cleaning solution. Only then is the reactor opened in order to take out the coated body. During the entire process, no pollution as a result of emissions occurs. The used electrolyte is stored in closed containers and has a very long storage life.

The present invention will be illustrated with the aid of nonlimiting FIGURES and examples.

The FIGURE shows:

FIG. 1 a schematic depiction of an apparatus according to the invention for carrying out the process of the invention

EXAMPLE 1

FIG. 1 is a schematic depiction of an apparatus according to the invention for carrying out the process of the invention. The apparatus 1 comprises a reactor 2 for carrying out the electrochemical process. The reactor 2 is closed by a lid 3 which can be taken off.

A body 4 to be coated, preferably a rotationally symmetric body, is introduced as cathode into the reactor 2. Furthermore, an anode 5 which preferably consists of platinated titanium is arranged in the reactor 2. The body 4 to be coated is connected via a rotatable rod 6 to the lid 3.

Electrolyte solution from the electrolyte containers 7, 8 can be introduced via connecting conduits 7*a*, 8*a* into the reactor 2. In FIG. 1, only two containers 7, 8 with respective connecting conduits 7*a*, 8*a* are shown; however, additional containers and connecting conduits can also be provided if required. The connecting conduits 7*a*, 8*a* can be opened and closed by means of shut-off devices 7*b*, 8*b*, which are preferably valves, so that only one particular electrolyte goes, in a targeted manner, into the reactor 2.

The connecting conduits 7*a*, 8*a* end in inlets which are arranged in the bottom plate of the reactor 2. Outlets via which electrolyte can flow out and flow back via connecting conduits 7*c*, 8*c* into the electrolyte containers 7, 8 are arranged in the upper third of the reactor 2. The connecting conduits 7*c*, 8*c* can be opened and closed by means of shut-off devices 7*d*, 8*d*, which are preferably valves, so that only one particular electrolyte goes, in a targeted manner, from the reactor 2 into the electrolyte container 7, 8 provided.

Pumps (not shown) are provided for conveying the electrolyte through the conduits 7*a*, 7*c*, 8*a*, 8*c*.

A rectifier 9 operated using an alternating voltage supplies the cathode 4 and anode 5 with the direct current necessary for the process via electric conductors 9*a*, 9*b*.

The apparatus 1 is controlled by means of an electronic process control unit (not shown).

According to the invention, the rotationally symmetric body is preferably pretreated before it is introduced into the reactor 2. After a mechanical surface treatment, for example by grinding or sandblasting, the surface of the body 4 is firstly cleaned using a cleaning cloth impregnated with ethanol. A film of polyethylene glycol 1500 (from Merck) is subsequently applied to the surface of the body 4 by means of a vibratory grinder.

The body 4, for example a steel cylinder, which has been pretreated in this way is introduced into the reactor 2 and the reactor 2 is closed by means of the lid 3. A mixture of 250 g of $CrO_3$ and 2.5 g of sulfuric acid in 1 l of water is then pumped as electrolyte from the container 7 into the reactor 2. The electrolyte is heated to 50° C. beforehand. The body 4 is rotated, electric current is applied and a first chromium layer is formed. During this first process step, the shut-off devices 7*b* and 7*d* are opened and the shut-off devices 8*b*, 8*d* are closed, and the electrolyte from the container 7 is circulated continuously.

After the first process step is complete, the shut-off device 7*b* is closed and the shut-off device 8*b* is opened instead. The shut-off device 7*d* remains open, while the shut-off device 8*d* is closed. A mixture of 250 g of $CrO_3$ and 2.5 g of sulfuric acid in 1 l of water is then pumped as electrolyte from the container 8 into the reactor 2. The electrolyte is heated to 37° C. beforehand. The electrolyte from the container 8 displaces the hotter electrolyte originating from the container 7 back into the container 7 via the conduit 7*c*. As soon as the electrolyte from the container 7 has been completely displaced from the reactor 2, the shut-off device 7*d* is closed and the shut-off device 8*d* is opened. The electrolyte from the container 8 is now present in the reactor 2. The body 4 is rotated, electric current is applied and a second chromium layer (structured layer) is formed. During this second process step, the shut-off devices 8*b* and 8*d* are opened, and the electrolyte from the container 8 is recirculated continuously.

After the second process step is complete, the shut-off device 8*b* is closed and the shut-off device 7*b* is opened instead. The shut-off device 8*d* remains open, while the shut-off device 7*d* is closed. A mixture of 250 g of $CrO_3$ and 2.5 g of sulfuric acid in 1 l of water is then pumped as electrolyte from the container 7 into the reactor 2. The electrolyte is heated to 50° C. beforehand. The electrolyte from the container 7 displaces the hotter electrolyte originating from the container 8 back into the container 8 via the conduit 8*c*. As soon as the electrolyte from the container 8 has been completely displaced from the reactor 2, the shut-off device 8*d* is closed and the shut-off device 7*d* is opened. The electrolyte from the container 7 is then present in the reactor 2. The body 4 is rotated, electric current is applied, and a third chromium layer (covering layer) is formed. During this third process step, the shut-off devices 7*b* and 7*d* are opened, and the electrolyte from the container 7 is circulated continuously.

During all process steps, the gas atmosphere in the reactor 2 can be drawn off by means of a pump (not shown) in order to prevent formation of a hydrogen/oxygen gas mixture.

After the third process step is complete, the shut-off device 7*b* is closed, while the shut-off device 7*d* remains open. The entire electrolyte is removed from the reactor 2. The coated body 4 is cleaned using water or an aqueous solution which is introduced from a conduit (not shown) into the reactor 2. The cleaning water is subsequently discharged from the reactor 2 and purified. The reactor 2 is then opened and the coated body 4 is taken out.

The invention claimed is:

1. A process for electrochemical application of a surface coating to a body, said surface coating being a chromium coating, the process comprising, the steps:

applying a layer of a polyhydroxy compound, which has a viscosity of at least 1000 mPas at 25° C., to the body before the electrochemical application of the surface coating;

providing a chromic acid containing solution as an electrolyte solution;

oxidizing said layer of said polyhydroxy compound by said chromic acid containing solution; and electrochemically applying said surface coating being said chromium coating using said chromic acid containing solution as said electrolyte solution.

2. The process as claimed in claim 1, further comprising selecting the polyhydroxy compound from the group consisting of glycerol, carbohydrates and polyethylene glycol.

3. The process as claimed in claim 1, further comprising cleaning the body with an alcohol before said application of the layer of the polyhydroxy compound.

* * * * *